US011530545B2

(12) United States Patent
Huang et al.

(10) Patent No.: US 11,530,545 B2
(45) Date of Patent: Dec. 20, 2022

(54) AUTOMATED POOL CLEANER WITH IMPROVED DEBRIS REMOVAL

(71) Applicant: Intex Marketing Ltd., Tortola (VG)

(72) Inventors: Zhi Xiong Huang, Fujian (CN); Wen Xiao Zhang, Fujian (CN); Yaw Yuan Hsu, Fujian (CN)

(73) Assignee: Intex Marketing Ltd., Tortola (VG)

( * ) Notice: Subject to any disclaimer, the term of this patent is extended or adjusted under 35 U.S.C. 154(b) by 73 days.

(21) Appl. No.: 16/973,933

(22) PCT Filed: Jun. 11, 2019

(86) PCT No.: PCT/IB2019/054863
§ 371 (c)(1),
(2) Date: Dec. 10, 2020

(87) PCT Pub. No.: WO2019/239316
PCT Pub. Date: Dec. 19, 2019

(65) Prior Publication Data

US 2021/0246677 A1 Aug. 12, 2021

(30) Foreign Application Priority Data

Jun. 11, 2018 (CN) ..... 201810597656.4
Jun. 11, 2018 (CN) ..... 201820899174.X

(51) Int. Cl.
*E04H 4/16* (2006.01)

(52) U.S. Cl.
CPC ..... *E04H 4/16* (2013.01); *E04H 4/1636* (2013.01); *E04H 4/1654* (2013.01)

(58) Field of Classification Search
CPC ..... E04H 4/16; E04H 4/1654
See application file for complete search history.

(56) References Cited

U.S. PATENT DOCUMENTS 6,725,489 B1 * 4/2004 Zell ..... E04H 4/1618 15/257.01
9,427,128 B2 * 8/2016 DeJonge ..... A47L 11/4016
2013/0152970 A1 * 6/2013 Porat ..... E04H 4/1654 134/18
2014/0014140 A1 1/2014 Correa
2017/0247896 A1 8/2017 Hayes et al.

FOREIGN PATENT DOCUMENTS

CN 106725100 A 5/2017
CN 107581971 A 1/2018
CN 108643617 A 10/2018
(Continued)

OTHER PUBLICATIONS

International Preliminary Report on Patentability received for PCT Patent Application No. PCT/IB2019/054863, dated Dec. 24, 2020, 7 pages.

(Continued)

*Primary Examiner* — Michael D Jennings
(74) *Attorney, Agent, or Firm* — Faegre Drinker Biddle & Reath LLP

(57) ABSTRACT

A pool cleaner including a housing, a driving assembly, a brush assembly, and a removable debris container. The removable debris container is coupled to the housing through a locking member in the brush assembly.

19 Claims, 7 Drawing Sheets

(56) References Cited

FOREIGN PATENT DOCUMENTS

| | | | |
|---|---|---|---|
| CN | 208363722 | U | 1/2019 |
| EP | 3144451 | A2 | 3/2017 |
| WO | 2016/081791 | A1 | 5/2016 |

OTHER PUBLICATIONS

International Search Report and Written Opinion received for PCT Patent Application No. PCT/IB2019/054863, dated Nov. 13, 2019, 9 pages.
European Search Report for EP Patent Application No. 19819932.5, dated Feb. 14, 2022, 5 pages.

* cited by examiner

AUTOMATED POOL CLEANER WITH IMPROVED DEBRIS REMOVAL

CROSS REFERENCE TO RELATED APPLICATIONS

This application is a national stage application of PCT International Application No. PCT/IB2019/054863, filed Jun. 11, 2019, which claims priority to the following Chinese patent applications under 35 U.S.C. § 119(b), the disclosures of which are hereby expressly incorporated by reference herein in their entirety:

| Chinese Application Number | Filing Date |
|---|---|
| 201820899174.X | Jun. 11, 2018 |
| 201810597656.4 | Jun. 11, 2018 |

FIELD OF THE DISCLOSURE

The present disclosure relates to a pool cleaner and a method of using the same to clean a pool.

BACKGROUND OF THE DISCLOSURE

A pool requires frequent cleaning to remove dirt and other debris. Manual cleaning is time consuming and inconvenient. Automated pool cleaners are available. However, it may be difficult to remove debris from such automated pool cleaners after use. For example, some automated pool cleaners must be flipped upside down, which risks the debris traveling into the pool cleaner. Furthermore, many devices utilized to detach debris containers from pool cleaners are bulky and take up space within the debris container itself.

SUMMARY

The present disclosure provides a pool cleaner comprising a housing, a driving assembly, a brush assembly, and a removable debris container. The removable debris container is coupled to the housing through a locking member in the brush assembly.

According to an embodiment of the present disclosure, a pool cleaner is disclosed comprising a housing and a driving assembly. The driving assembly comprises at least one traction assembly. The pool cleaner further comprises a brush assembly pivotally coupled to the housing, and a latch pivotally coupled to the brush assembly housing through at least one coupling member and at least one locking member. The pool cleaner further comprises a debris container. The debris container is removably coupled to the pool cleaner through the at least one locking member.

According to another embodiment of the present disclosure, an automated pool cleaner is disclosed comprising a housing, a brush assembly, and a debris container. The brush assembly is pivotally coupled to the housing and comprises a brush, a first locking member, and a second locking member. The debris container is removably coupled to the housing and the brush assembly, and comprises at least one contact surface, at least one contact member, and at least one locking edge.

According to yet another embodiment of the present disclosure, a pool cleaner is disclosed, comprising a housing and a brush assembly. The brush assembly comprises a gear assembly pivotally coupled to the housing, a brush assembly body coupled to the gear assembly, a brush rotatably coupled to the brush assembly body, a latch pivotally coupled to the brush assembly body, a first locking member coupled to the latch, at least one second locking member coupled to the brush assembly body, and at least one elastic member coupled to the brush assembly body and the latch. The at least one elastic member maintains the latch in a first position, and accommodates movement of the latch to a second position. The pool cleaner further comprises a driving assembly disposed within the housing. The pool cleaner further comprises at least one traction assembly coupled to the driving assembly. The pool cleaner also comprises a debris container removably coupled to the housing. The debris container comprises a suction port, at least one locking edge coupled to the debris container and configured to interface with at least the first locking member, at least one contact member coupled to the debris container and configured to interface with at least the second locking member, and at least one contact surface coupled to the debris container and configured to interface with the brush assembly.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
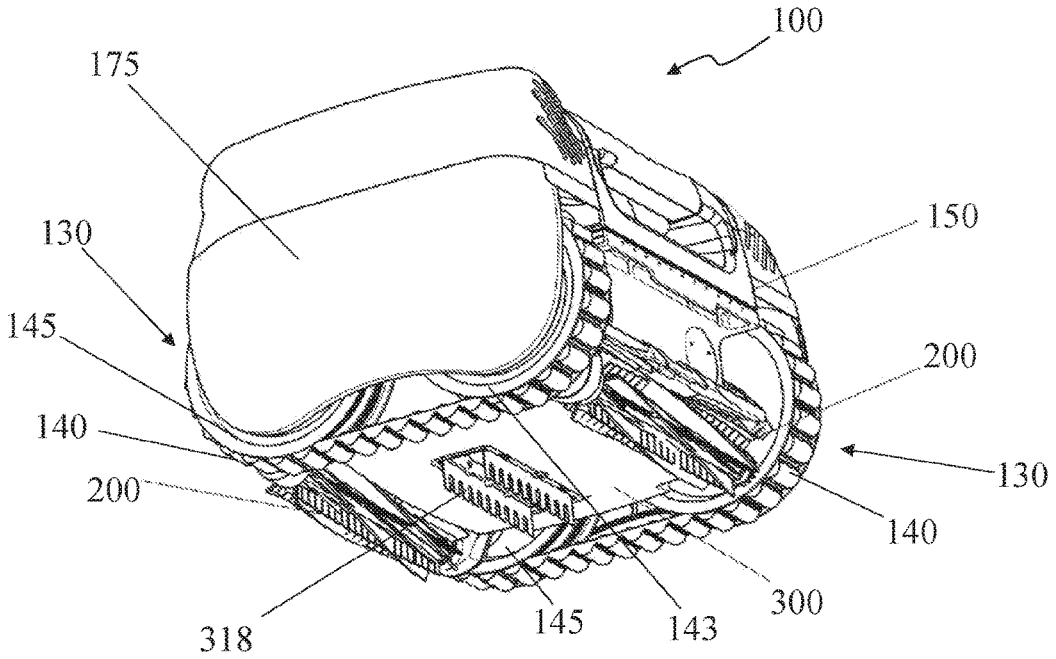
FIG. 1 is a perspective view of an automated pool cleaner of the present disclosure.

An automated pool cleaner 100 is shown in FIG. 1. The pool cleaner 100 comprises a housing 150, a motorized driving assembly (not shown) disposed within the housing 150, one or more traction assemblies 130, one or more brush assemblies 200, and a debris container 300.

The illustrative pool cleaner 100 includes two traction assemblies 130 located on opposing left and right sides of the pool cleaner 100, but it is understood that the pool cleaner 100 may have different numbers or arrangements of traction assemblies 130. In the illustrated embodiment, each traction assembly 130 comprises a first wheel 143 driven by the driving assembly, a track 140 driven by the first wheel 143, and a second wheel 145 driven by the track 140. The traction assemblies 130 drive the pool cleaner 100 across the bottom or sides of a pool. Pool cleaner 100 further comprises at least one shield 175 coupled to the housing 150 to cover and protect respective traction assemblies 130. In other embodiments, traction assemblies 140 may comprise at least one wheel without a track, and may be made of plastic, rubber, or any other material with high friction.

Figure 2:
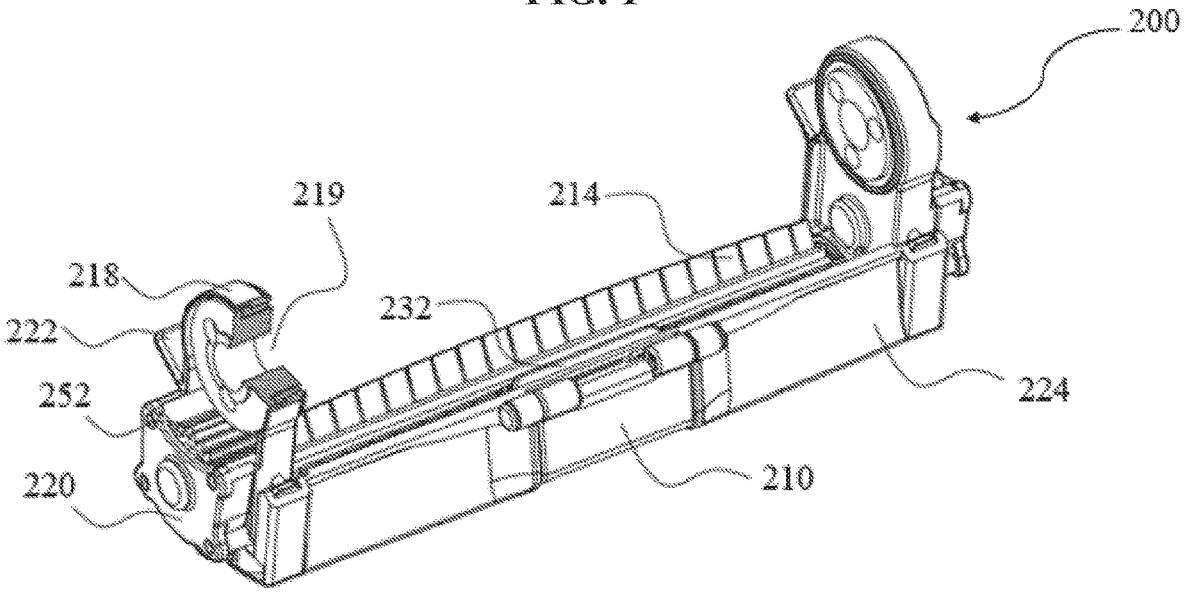
FIG. 2 is a perspective view of a brush assembly of the pool cleaner.
Figure 3:
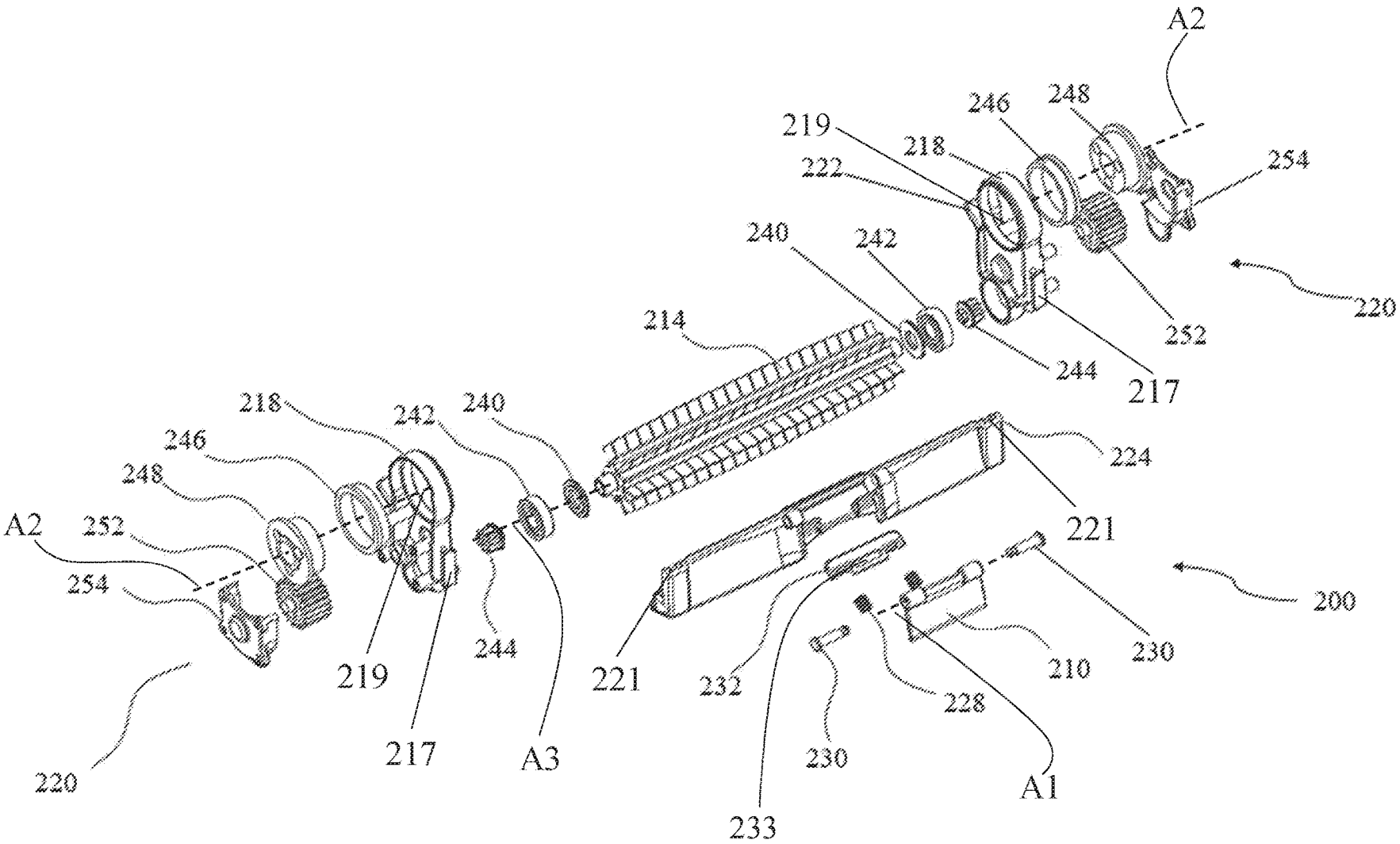
FIG. 3 is an exploded view of the brush assembly of FIG. 2.

The illustrative pool cleaner 100 also includes two brush assemblies 200 located on opposing front and rear ends of the pool cleaner 100 and arranged generally perpendicular to and between the left and right traction assemblies 130, but it is understood that the pool cleaner 100 may have different numbers or arrangements of brush assemblies 200. Each illustrative brush assembly 200 of FIGS. 1-3 includes a brush 214, a brush assembly body 224, left and right gear assemblies 220, left and right gear brackets 218 each having upper pivot apertures 219, a latch 210, a first locking member 232 that extends inward through the brush assembly body 224 toward the debris container 300 (FIG. 1), and left and right second locking members 222 that extend inward from the respective gear brackets 218 toward the debris container 300 (FIG. 1). The opposing gear brackets 218 may be coupled to the adjacent brush body assembly 224 via tongues 217 and corresponding grooves 221 or other suitable coupling mechanisms. The latch 210 is pivotably coupled to brush assembly body 224 about an axis A1 through coupling members or pins 230. A hook 231 (FIG. 5) extends inward and downward from latch 210 and into aperture 233 of first locking member 232 such that rotating latch 210 causes first locking member 232 to slide inward and outward relative to brush assembly body 224. Elastic members 304 are seated in the brush assembly body 224 and press against first locking member 232 such that elastic members 304 urge the first locking member 232 away from the brush assembly body 224 and inward toward the debris container 300. Because the first locking member 232 is biased inward, the hook 231 of the latch 210 is also pulled inward, which biases the latch 210 downward about the axis A1. In the illustrated embodiment, elastic members 304 are springs.

Each gear assembly 220 comprises an outer gear housing 254, a first driven brush gear 252, a second driven brush gear 244, a fixing member 248, a fixing sleeve 246, a bearing 242, and a spacer 240. The upper pivot aperture 219 of each gear bracket 218 is pivotally coupled to the housing 150, such that the brush assembly 200 may rotate about an axis A2 to swing the brush assembly 200 away from the debris container 300, thereby unlocking the debris container 300. Brush 214 is coaxially coupled to second brush gear 244 through bearing 242, and second brush gear 244 is coupled to gear bracket 218 through spacer 240. When in use, a motor (not shown) rotates first driven brush gear 252, and first driven brush gear 252 meshes with and drives second driven brush gear 244. Second driven brush gear 244 drives brush 214 to rotate along an axis A3, coaxial with brush 214. First driven brush gear 252 is coupled to gear housing 254 and is also coupled to gear bracket 218.

Figure 4:
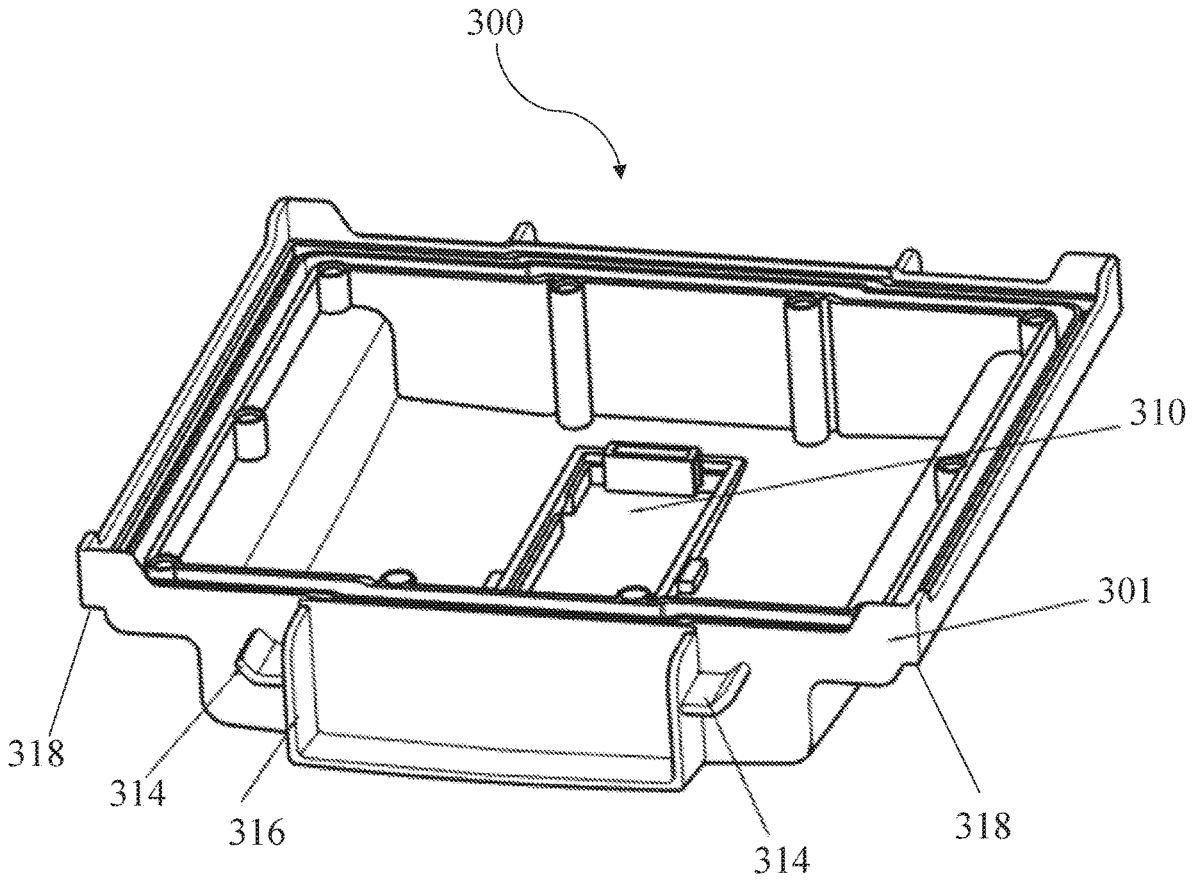
FIG. 4 is a perspective view of a debris container removed from the pool cleaner.
Figure 5:
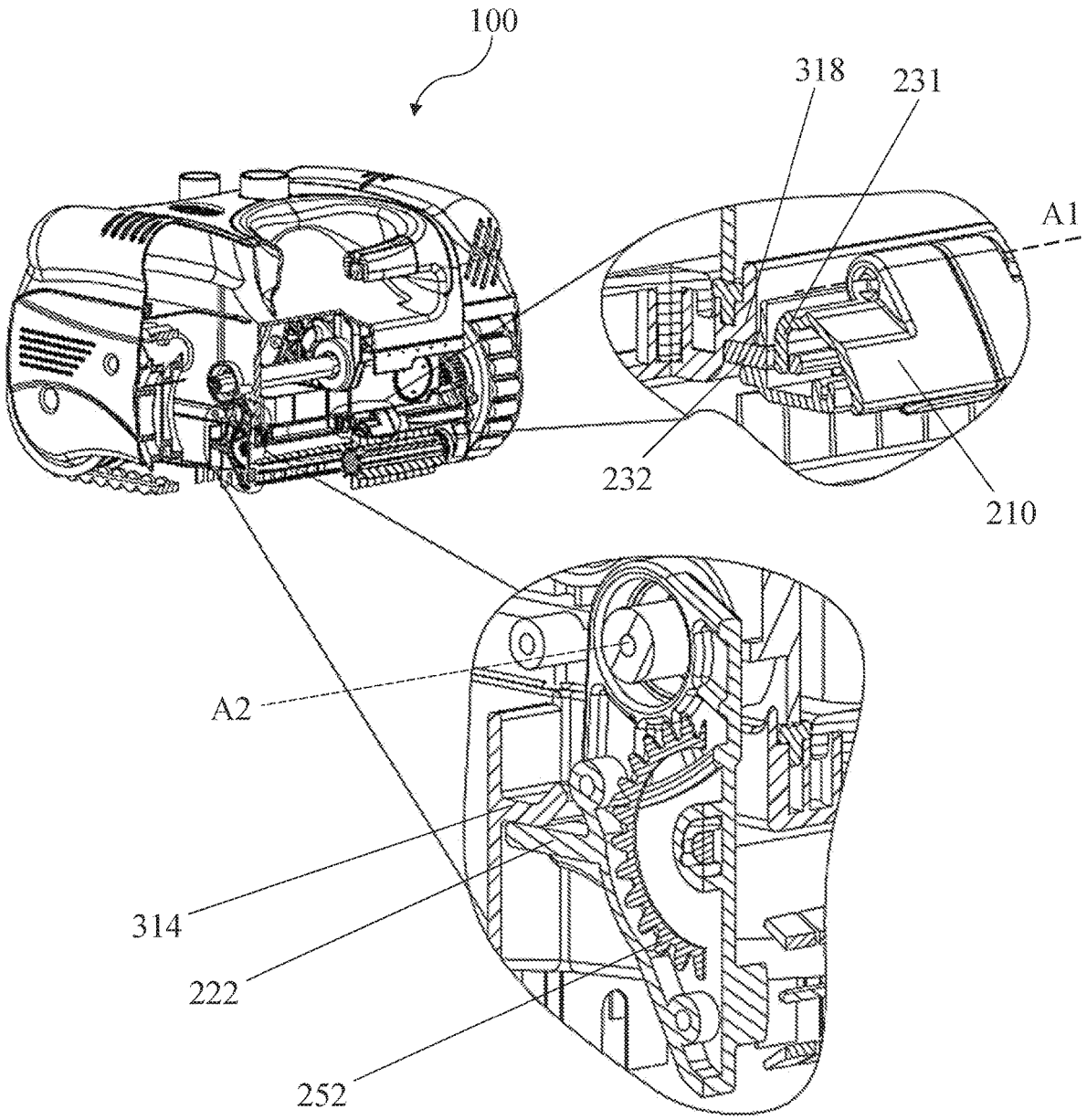
FIG. 5 is a cross-sectional view of the pool cleaner with the debris container in a locked configuration

Referring to FIG. 4, the illustrative debris container 300 comprises a debris container body 301, at least one locking edge 318, a plurality of contact members or tabs 314, a plurality of contact walls 316, and a suction port 310. In the illustrated example, debris container 300 includes two locking edges 318 integrally constructed as part of debris container body 301 and located on opposing front and rear ends of the debris container 300 to interface with first locking members 232 (FIG. 5). In other embodiments, locking edge 318 may comprise a wall, surface, ledge, or other rigid surface coupled to debris container body 301. Contact members 314 and contact walls 316 are coupled to the debris container 301 and are located on opposing left and right sides of the debris container 300 to interface with second locking members 222 (FIG. 5). Suction port 310 is located at the base of debris container 301. In other embodiments, debris container 300 may comprise more than one suction port 310.

When in use, the motor (not shown) drives brush 214 through the gear assemblies 220 as described above. Suction is created by the motor or an external suction source connected to the pool cleaner such as a vacuum or pump (not shown). The suction causes fluid to flow into the pool cleaner 100 through suction port 310. Brush 214 rotates about axis A3 parallel to axis A2 to sweep debris from the floor or walls of the pool (not shown) into suction port 310. As pool cleaner 100 sweeps the floor or walls of the pool, debris is collected within debris container 300.

FIGS. 5-8 detail the process of removing the debris container 300 from housing 150 to empty the collected debris. FIG. 5 shows debris container 300 in a locked configuration wherein debris container 300 is securely coupled to the housing 150. This configuration can be utilized when the pool cleaner 100 is in use. In the locked configuration, the elastic members 228 bias the latch 210 downward in a first position, thereby resisting rotation about the axis A1. First locking member 232 is in contact with and positioned under locking edge 318, and second locking members 222 are in contact with and positioned under contact members 314. The coupling of first and second locking members 232 and 222 to debris container 300 result in the coupling of debris container 300 to housing 150. In the illustrated embodiment, the pool cleaner 100 comprises two brush assemblies 200, and the debris container comprises two locking edges 318 and four contact members 314. Both brush assemblies 200 couple debris container 300 to housing 150 in the configuration described above. In other embodiments, pool cleaner 100 may comprise only one brush assembly 200 located on a free side of the debris container 300 and a hinge (not shown) located on a hinged side of the debris container 300 opposite the free side. In this embodiment with a hinge, only one brush assembly 200 would be unlocked to release the free side of the debris container 300, and debris container 300 would swing open with the hinged side rotating around the hinge such that debris container 300 would not fully separate from pool cleaner 100. In other embodiments, pool cleaner 100 may also comprise more than two brush assemblies 200.

Figure 6:
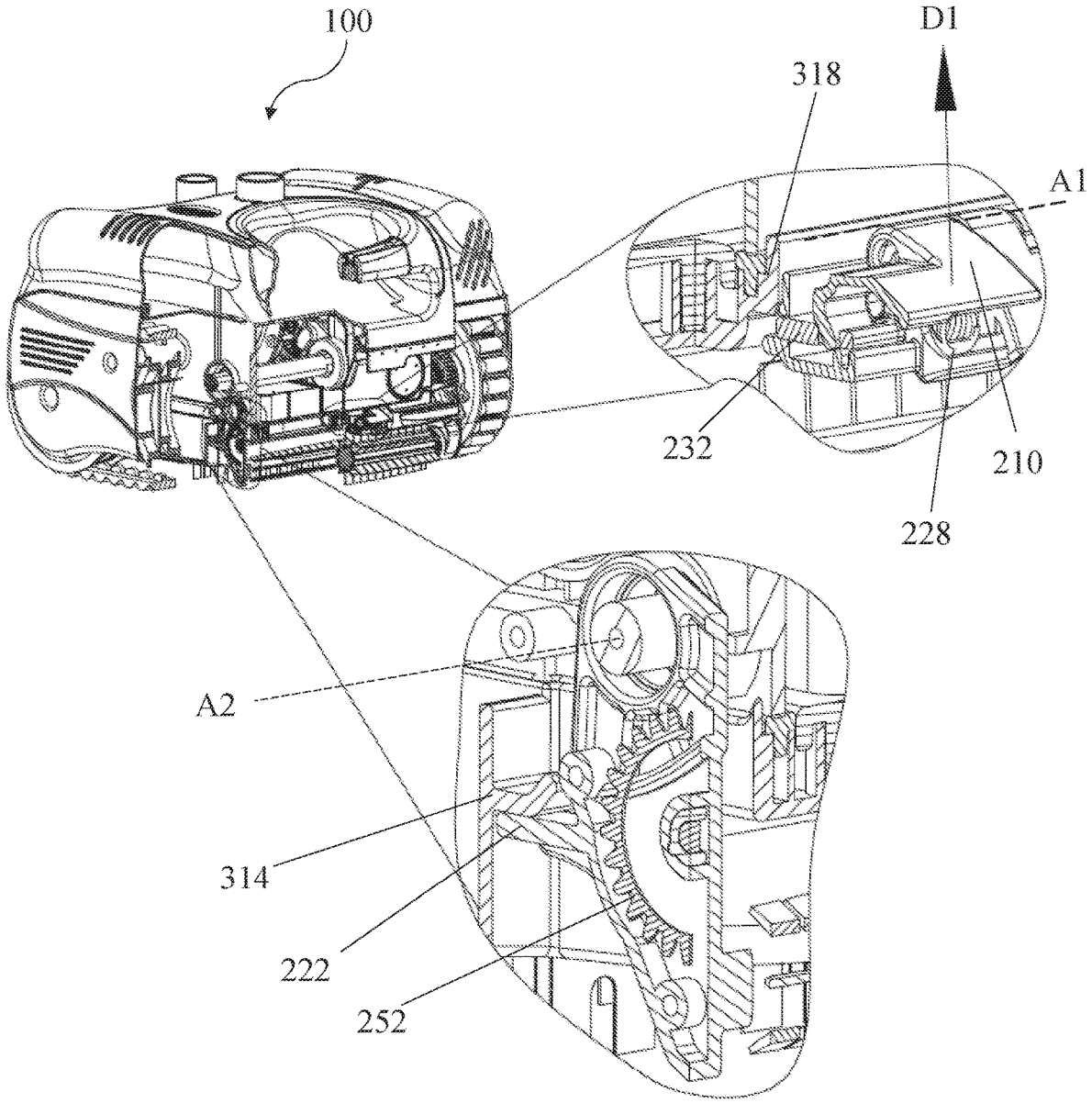
FIG. 6 is a cross-sectional view of the pool cleaner with the debris container in an initial unlocked configuration.

FIG. 6 shows an initial unlocked configuration with the rotation of latch 210 around axis A1 to a second position, which pulls first locking member 232 out from contact with locking edge 318. More specifically, the user rotates the latch 210 upward in the direction of arrow D1, which causes the hook 231 to tilt downward and outward while pulling the first locking member 232 outward. Elastic member 228 compresses between the withdrawn first locking member 232 and the brush assembly body 224 to resist rotation of the latch 210 about axis A1 and said resistance must be overcome by the user to further rotate latch 210 about axis A1. Once first locking member 232 has been removed from contact with locking edge 318, brush assembly 200 is free to rotate about axis A2, as described below.

Figure 7:
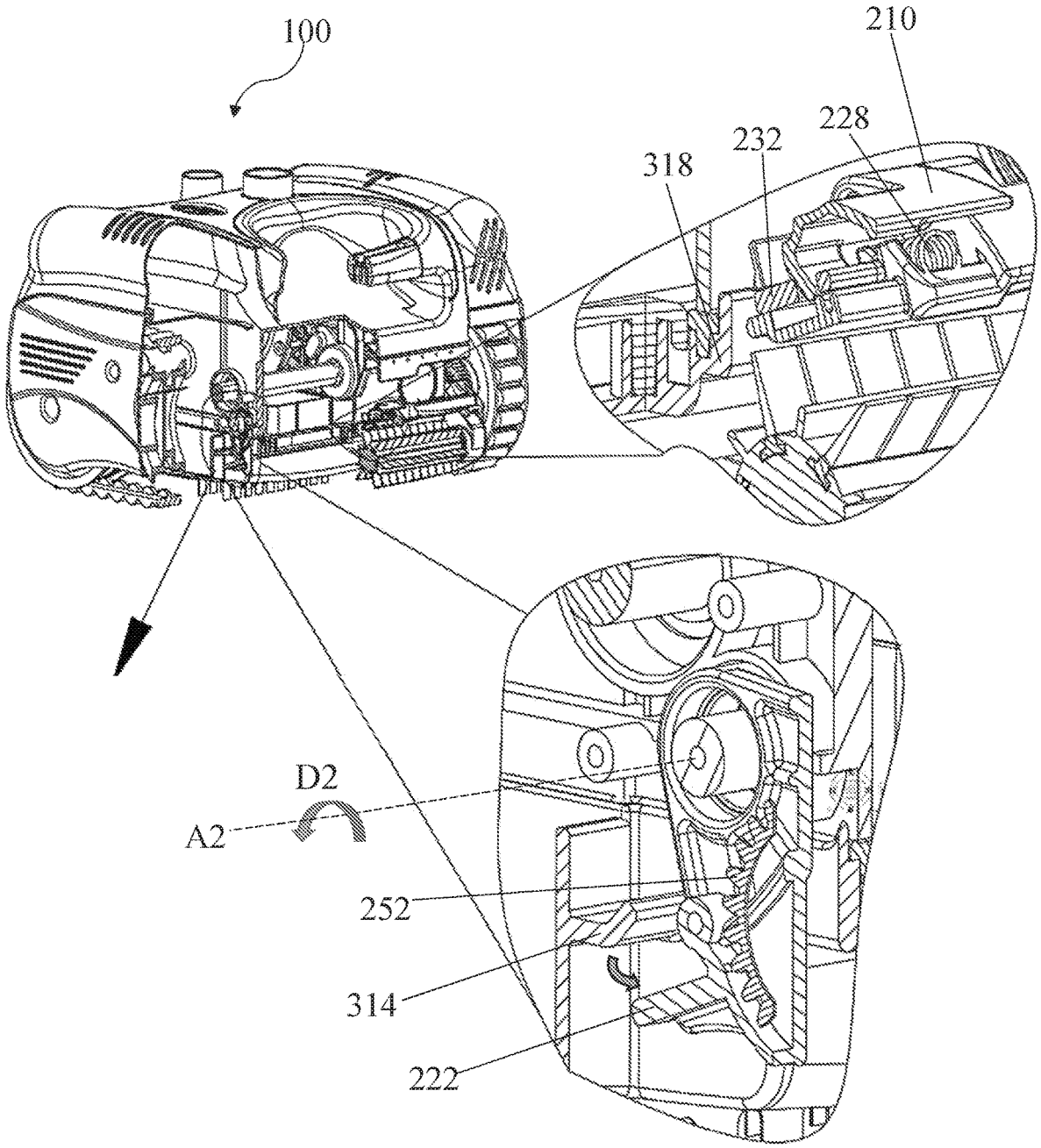
FIG. 7 is a cross-sectional view of the pool cleaner with the debris container in an intermediate unlocked configuration.

FIG. 7 shows an intermediate unlocked configuration with the rotation of brush assembly 200 about axis A2. This configuration may be achieved by continuing to pull the latch 210 outward, which causes the brush body assembly 224 and the attached gear brackets 218 to rotate outward about axis A2 in the direction of arrow D2. This outward rotation about axis A2 allows second locking member 222 to be removed from contact with contact member 314. This outward rotation also allows the first locking member 232 to be separated from locking edge 318.

Figure 8:
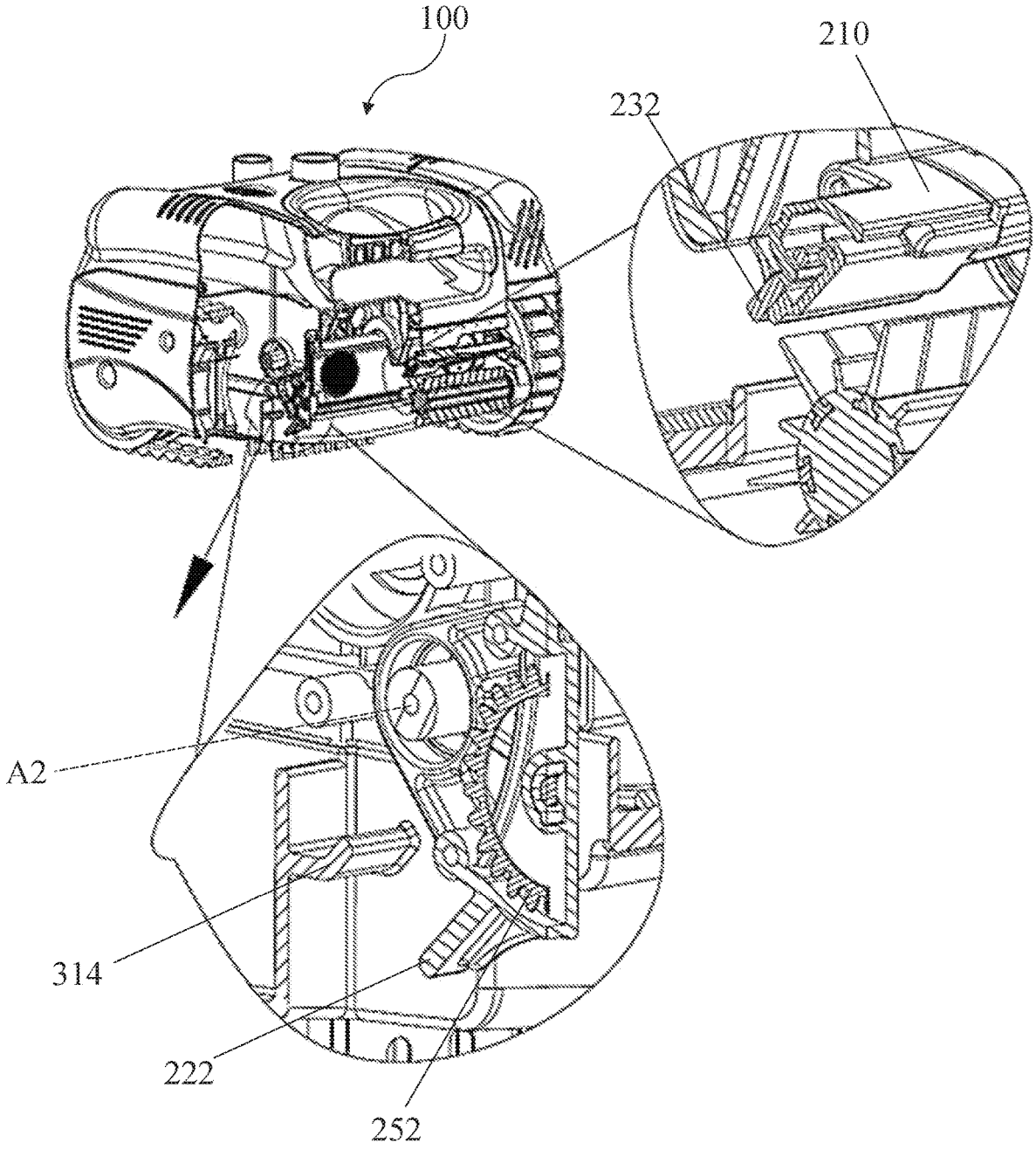
FIG. 8 is a cross-sectional view of the pool cleaner with the debris container in a fully unlocked configuration.

FIG. 8 shows a final unlocked configuration of first locking member 232 separated from locking edge 318 (FIG. 7) and second locking member 222 separated from contact member 314. As shown in FIG. 8, the user may release the latch 210 back to its downward-biased position without re-engaging the locking edge 318. In this configuration, debris container 300 is able to be separated from housing 150 by pulling debris container 300 downward and/or allowing debris container 300 to fall freely downward from the housing 150 under gravitational force. Once separated, debris container 300 may be emptied of debris, then recoupled to housing 150 for subsequent use.

Debris container 300 may be recoupled to housing 150 by following the steps of FIGS. 5-8 in reverse order. To recouple debris container 300 to housing 150, debris container 300 is brought up to housing 150 from below (FIG. 8). Brush assembly 200 is rotated inward about axis A2 to bring second locking member 222 in contact with contact member 314 (FIGS. 6 and 7). Latch 210 is rotated outward slightly about axis A1 to bring first locking member 232 into alignment with locking edge 318 (FIG. 6). Latch 210 is then released inwardly, and elastic member 228 returns latch 210 to the first position with first locking member 232 contacting locking edge 318 to fixedly couple debris container 300 to housing 150 (FIG. 5).

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pool cleaner comprising:
- a housing;
- a driving assembly comprising at least one traction assembly configured to drive the housing;
- at least one brush assembly comprising a brush assembly body pivotally coupled to the housing a brush, and at least one locking member;
- a debris container removably coupled to the housing through the at least one locking member;
- wherein the pool cleaner has:
  - a locked configuration in which the at least one locking member is coupled to the debris container; and
  - an unlocked configuration in which the at least one locking member is separated from the debris container.

2. The pool cleaner of claim 1, further comprising a latch that is rotatable about an axis through at least one latch fastener to removably couple the debris container to the housing.

3. The pool cleaner of claim 2, wherein the latch comprises a hook, and the at least one locking member comprises an aperture, the hook extending from the latch and into the aperture such that rotating the latch causes the at least one locking member to move relative to the brush assembly body.

4. The pool cleaner of claim 1, wherein the debris container comprises at least one locking edge, the locking member positioned beneath the locking edge when the debris container is coupled to the housing.

5. The pool cleaner of claim 1, wherein the debris container comprises a suction port.

6. The pool cleaner of claim 1, wherein the traction assembly comprises wheels or treads.

7. The pool cleaner of claim 1, wherein the pool cleaner transitions from the locked configuration to the unlocked configuration via rotation of the brush assembly body relative to the housing.

8. An automated pool cleaner comprising:
- a housing;
- a driving assembly comprising at least one traction assembly configured to drive the housing;
- a shield coupled to the housing and configured to cover the at least one traction assembly;
- a brush assembly pivotally coupled to the housing and comprising a brush, a first locking member, and a second locking member; and
- a debris container removably coupled to the housing and the brush assembly and comprising at least one locking edge and at least one contact member, the locking edge configured to engage the first locking member, and the contact member configured to engage the second locking member.

9. The pool cleaner of claim 8, wherein the brush assembly further comprises a latch coupled to the first locking member and at least one elastic member that biases the latch downward in a first position.

10. The pool cleaner of claim 9, wherein the at least one elastic member is a spring.

11. The pool cleaner of claim 9, wherein the latch is held in a first position by the at least one elastic member, and is rotatable about an axis coaxial with at least one latch fastener to a second position.

12. The pool cleaner of claim 11, wherein the debris container is fixedly coupled to the housing when the latch is in the first position, and the debris container is separable from the housing when the latch is in the second position.

13. The pool cleaner of claim 8, wherein the brush assembly further comprises at least one gear assembly that is coupled to the housing and is driven by a motor to rotate the brush about an axis.

14. The pool cleaner of claim 13, wherein the gear assembly comprises
- a gear housing coupled to the housing and to the brush assembly,
- a first and a second brush gear coupled to the gear assembly and configured to rotate simultaneously,
- a fixing member coupled to the housing,
- a fixing sleeve coupled to the fixing member and to the gear assembly,
- a bearing coupled to the second brush gear, and
- a spacer coupled to the brush and the bearing.

15. The pool cleaner of claim 14, wherein the first and second brush gears are interlocked such that rotation of the first brush gear will rotate the second brush gear, and the rotation of the second brush gear will rotate the brush about an axis coaxial with the brush.

16. A pool cleaner comprising:
- a housing;
- a brush assembly comprising:
  - a gear assembly pivotally coupled to the housing;
  - a brush assembly body coupled to the gear assembly;
  - a brush rotatably coupled to the brush assembly body;

a latch coupled to the brush assembly body;

a first locking member coupled to the latch;

at least one second locking member coupled to the brush assembly body;

at least one elastic member coupled to the brush assembly body and the latch such that the at least one elastic member maintains the latch in a first position and accommodates movement of the latch to a second position;

a driving assembly disposed within the housing;

at least one traction assembly coupled to the driving assembly; and a debris container removably coupled to the housing and comprising:

a suction port;

at least one locking edge configured to interface with the first locking member;

at least one contact member configured to interface with the at least one second locking member; and at least one contact wall coupled to the debris container and configured to interface with the brush assembly.

17. The pool cleaner of claim 16, wherein the first locking member extends beneath the locking edge, and the at least one second locking member extends beneath the at least one contact member when the debris container is coupled to the housing.

18. The pool cleaner of claim 17, wherein the latch is rotatable about a first axis to decouple the first locking member from the locking edge, and the brush assembly is rotatable about a second axis to decouple the at least one second locking member from the at least one contact member to remove the debris container from the housing.

19. The pool cleaner of claim 16, wherein the brush rotates relative to the brush assembly body when the pool cleaner is in use to sweep debris into the debris container through the suction port.

* * * * *